US006802983B2

(12) United States Patent
Mullee et al.

(10) Patent No.: US 6,802,983 B2
(45) Date of Patent: Oct. 12, 2004

(54) PREPARATION OF HIGH PERFORMANCE SILICA SLURRY USING A CENTRIFUGE

(75) Inventors: William Mullee, Portland, OR (US); Glen Jenkins, Austin, TX (US); Michael Jones, Phoenix, AZ (US)

(73) Assignee: Advanced Technology Materials, Inc., Danbury, CT (US)

( * ) Notice: Subject to any disclaimer, the term of this patent is extended or adjusted under 35 U.S.C. 154(b) by 0 days.

(21) Appl. No.: 09/954,231

(22) Filed: Sep. 17, 2001

(65) Prior Publication Data

US 2003/0054734 A1 Mar. 20, 2003

(Under 37 CFR 1.47)

(51) Int. Cl.[7] ..... B01D 37/00; B01D 21/26

(52) U.S. Cl. ..... 210/749; 210/774; 210/781; 210/787; 210/806; 210/295; 451/88; 494/37

(58) Field of Search ..... 210/749, 774, 210/781, 787, 806, 198.1, 295, 304, 360.1, 380.1; 494/67, 68, 70, 37; 451/88

(56) References Cited

U.S. PATENT DOCUMENTS 3,125,516 A * 3/1964 Kaldewey ..... 494/70
4,557,831 A 12/1985 Lindsay et al.
4,634,536 A 1/1987 Grimwood et al.
5,203,121 A * 4/1993 Metzger ..... 451/88
5,399,262 A * 3/1995 Hawkins et al. ..... 210/295
5,919,124 A 7/1999 Corlett et al.
5,928,492 A * 7/1999 Corlett et al. ..... 210/774
6,059,712 A * 5/2000 Corlett et al. ..... 494/67
6,322,710 B1 * 11/2001 Katsumata et al. ..... 210/380.1

FOREIGN PATENT DOCUMENTS

EP 0 849 040 A2 * 6/1998

* cited by examiner

*Primary Examiner*—David A. Reifsnyder
(74) *Attorney, Agent, or Firm*—William F. Ryann; Margaret Chappuis

(57) ABSTRACT

A method and system for separating impurities, such as large abrasive particles and foreign matter from an abrasive polishing slurry prior to a Chemical Mechanical Polishing (CMP) procedure performed on a surface of a semiconductor wafer. Impurities greater than about 25 microns are removed by an initial filtration process. The filtrate is then introduced to a solid bowl, sedimentation-type centrifuge to remove particles greater than 0.5 microns thereby providing a polishing slurry for final utilization in a CMP procedure that reduces damage to the surface of the polished semiconductor wafer.

16 Claims, 2 Drawing Sheets

PREPARATION OF HIGH PERFORMANCE SILICA SLURRY USING A CENTRIFUGE

BACKGROUND OF THE INVENTION

1. Field of the Invention

The present invention relates to the field of Chemical Mechanical Polishing (CMP), and more particularly, to methods and systems for separating large particles and foreign matter from an abrasive polishing slurry prior to polishing workpieces.

2. Description of the Related Art

Chemical Mechanical Polishing is a method of polishing materials, such as semiconductors substrates, to a high degree of planarity and uniformity. The process is used to planarize semiconductor slices prior to the fabrication of semiconductor circuitry thereon, and is also used to remove high elevation features created during the fabrication of microelectronic circuitry on the substrate. One typical chemical mechanical polishing process involves rotating a semiconductor wafer on a polishing pad, applying pressure through a rotating chuck, and supplying an aqueous polishing slurry containing an abrasive polishing agent to the polishing pad for abrasive action. Specifically, the abrasive agent is interposed between the wafer and polishing pad to planarize the surface.

Generally, abrasive polishing agents used in chemical mechanical slurries include particles of fumed silica, colloidal silica, cerium oxide and/or alumina particles. Fine silica particles are often used as the polishing agent in a CMP process, because silica particles exhibit good dispersion and uniformity in average particle dimension. The fine silica particles are dispersed in a dispersion medium, such as water, and used as a silica suspension.

The slurry and material removed from the semiconductor wafer during a polishing process form a waste stream that is commonly disposed of as industrial waste because reuse of the polishing slurry that contains large-sized polishing refuse or aggregation may cause damage to the polished surface. However, the disposal of dissolved or suspended solids in the industrial waste stream has become a relevant environmental issue due to strict local, state and federal regulations. As such, it would be desirable to provide a process and apparatus to remove abrasive components from the waste stream for possible reprocessing and reuse as a chemical mechanical slurry.

Conventional techniques for reclamation of water and separation of large particles typically greater than 3–4 microns in diameter include reverse osmosis filtration, microfiltration, centrifugation using a screen bowl centrifuge or electrophoresis. However, such techniques are commonly limited to batch processing or have low throughput volumes. Further, these techniques are not readily adapted to high volume, continuous service. Also, these conventional methods do not attain sufficient removal of larger diameter particles that otherwise can cause surface damage to the semiconductor wafers including scratches, pits and other flaws.

U.S. Pat. No. 4,634,536 describes a method and process using a screen bowl centrifuge for separation. However, separation is limited to batch processes and further limited by clogging of the screen in the centrifuge as solids tend to build up on the screen.

Accordingly, there is a need for an improved separation process and system for polishing slurries wherein the process and system provide a high volume continuous flowthrough and ensure continuity in particle size thereby reducing the risk of damage to the polished surface incident to the presence of larger diameter particles and agglomerated solids.

SUMMARY OF THE INVENTION

The present invention relates to a process and system for treatment of CMP slurry compositions to remove overlarge solids therefrom, so that the CMP operation is correspondingly enhanced in operational efficacy.

In one aspect, the present invention relates to a process and system to remove particles having a diameter greater than about 0.5 microns from an abrasive slurry thereby ensuring reduced scratching of a surface substrate during a subsequent polishing process.

Another aspect relates to a closed loop slurry supply system for recovery and reuse of components of an aqueous chemical mechanical polishing abrasive slurry thereby reducing the cost of the chemical mechanical polishing process.

Yet another aspect of the present invention relates to a recovery process that reduces the adverse environmental impact of the polishing process.

Still another aspect of the present invention relates to a continuous method and system of separation operable at suitable flow rates to support high volume flow of a polishing slurry to a polishing apparatus of the type generally used in the semiconductor industry, and/or waste produced by such a polishing apparatus.

The present invention in one aspect relates to a method for continuous separation and removal of potentially damaging particles from a polishing slurry prior to a chemical mechanical polishing process utilizing such slurry, the method comprising:

filtering a polishing slurry comprising at least one abrasive polishing agent through a filter having a pore size not greater than 25 microns;

introducing the filtered polishing slurry into a solid bowl, sedimentation-type centrifuge comprising a vertical stack of thin discs;

separating abrasive polishing particulates having a particle size greater than about 0.5 micron from the filtered polishing slurry and continuously ejecting the particulates through nozzles on the solid bowl sedimentation-type centrifuge to yield a product slurry; and continuously removing the product slurry from the centrifuge having abrasive particles of about 0.5 microns and less, to provide a polishing slurry for chemical mechanical polishing.

According to another embodiment of the present invention, a polishing agent separation system comprises a filter means for removing particles larger than 25 microns, and a means for separating particles larger than 0.5 microns from the polishing slurry.

Preferably, the solid bowl, sedimentation-type centrifuge is equipped with a disc-type bowl having a double conical solid holding space which is fitted with nozzles at the periphery of the bowl. Separation of larger abrasive particles from the aqueous polishing slurry takes place in the disc stack, wherein the solids slide down into the double-conical solid holding space and are continuously discharged through the nozzles.

The separation methods of the present invention may be used for processing new polishing slurries and recovered polishing slurries used in a previous polishing process to ensure a non-damaging polishing slurry that is essentially devoid of foreign matter or aggregates that exceed 0.5 microns.

The aqueous polishing slurries treated according to the present invention act to mechanically and chemically abrade and remove the surface of the workpiece to a desired extent.

Another embodiment of the present invention is directed to a method for separating and removing potentially damaging particles from a waste polishing slurry recovered from a chemical mechanical polishing process, the method comprising:

filtering the waste slurry comprising abrasive polishing particulates and waste debris through a filter having a pore size not greater than 25 microns;

introducing the filtered waste slurry into a solid bowl, sedimentation-type centrifuge having a vertical stack of thin discs;

separating abrasive polishing particulates and waste debris having a particle size greater than about 0.5 micron and ejecting same through nozzles on the periphery of the solid bowl sedimentation-type centrifuge yielding a purified polishing slurry; and continuously removing the purified polishing slurry from the solid bowl sedimentation-type centrifuge, wherein the polishing slurry comprises particles having a diameter not exceeding about 0.5 microns to provide a polishing slurry that reduces damage to polished surface during a subsequent chemical mechanical polishing process, relative to corresponding use of the waste slurry.

These and other aspects and advantages of the invention will become apparent from the following detailed description and the accompanying drawings, which illustrate by way of example the features of the present invention.

DETAILED DESCRIPTION OF THE PREFERRED EMBODIMENTS

Figure 1:
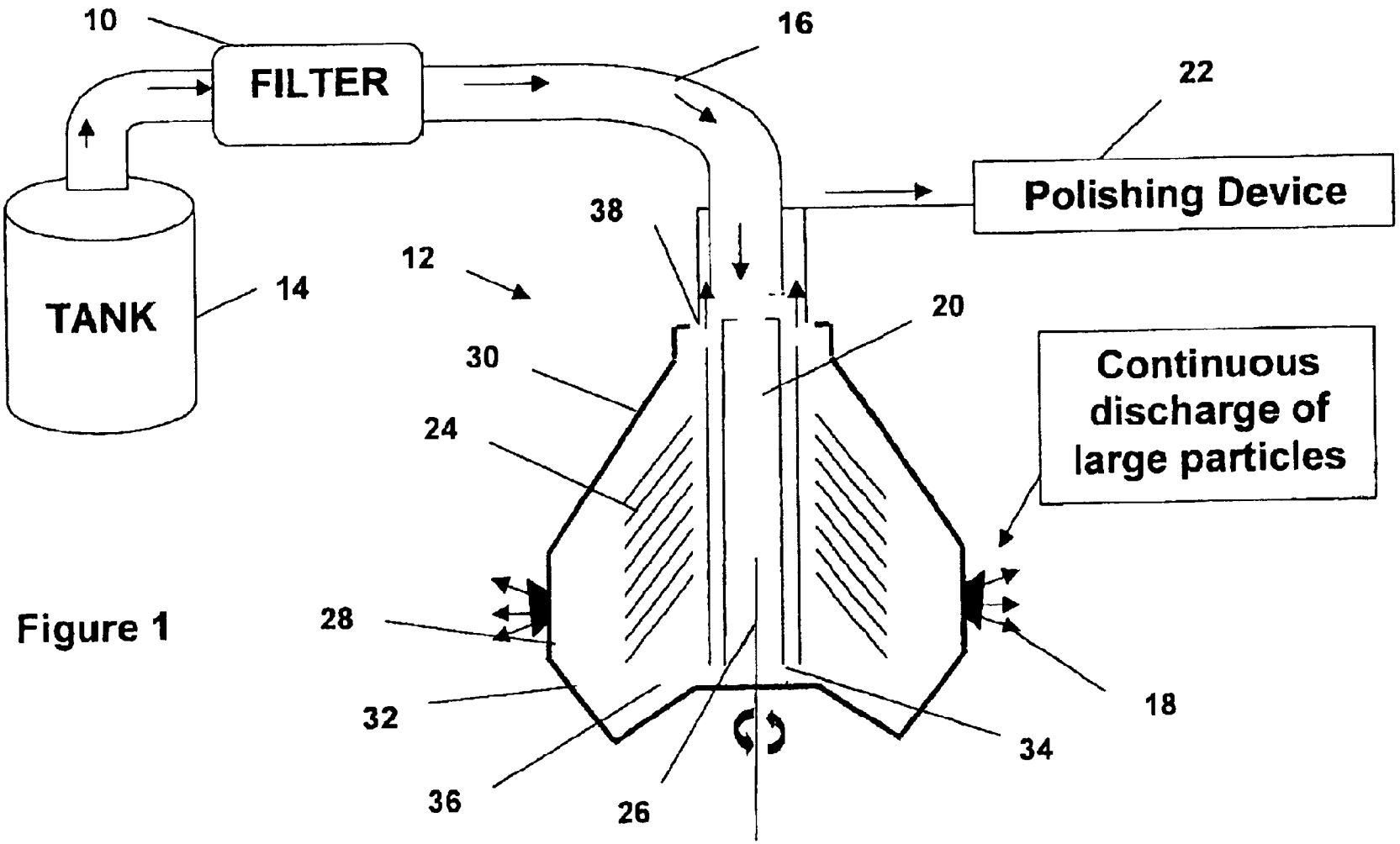
FIG. 1 a diagrammatic view of the method and system of a first embodiment of the present invention for treating slurries before use in a chemical and mechanical polishing system.

As is illustrated in the drawings, the invention is accordingly embodied in a method and system for removing larger particles of abrasive materials from an aqueous polishing slurry comprising abrasive materials. Referring to FIG. 1, in a first preferred embodiment, a method and system for removing larger particles from an aqueous polishing slurry comprise a filter 10 and a disc-nozzle centrifuge 12. The aqueous slurry containing abrasive particles used as polishing agents may be stored in storage tank 14 before flowing through the filter 10 and centrifuge 12 for final utilization in a CMP procedure 22.

The abrasive polishing agents of the present invention are not limited to any particular agent. The polishing agent may include inorganic oxide particles, such as silica, alumina, cerium oxide, or the like. Although, the preferred size range for polishing particles is about 10 nm to about 500 nm, maintenance of this particle size range is not always possible because the polishing agent may also include aggregates of these particles. As such, particles having diameter greater than 500 nm are found in aqueous slurries and the method and system of the present invention provide for separation of such particles thereby reducing the occurrence of surface damage that would otherwise be experienced by the substrate subjected to CMP processing. Particle size as used herein refers to the average diameter of the particles, or if the particles are not substantially spherical, the average maximum dimension of the particle.

A preferred polishing agent is colloidal or fumed silica which are commercially available from several sources. Generally, colloidal silica is made by reacting an alkaline silicate solution, such as sodium silicate with a mineral acid, such as sulfuric acid and generally under alkaline reaction conditions. Colloidal silica is the major reaction product formed by the polymerization of active silicic acid around nuclei to form particles. Following colloidal particle formation the solution is concentrated using methods well known to those skilled in the art. Fumed or pyrogenic silica is formed by flame hydrolysis process utilizing silanes as the feed stream. Fumed silica thus produced is a powder and needs to be subsequently dispersed in an aqueous or non-aqueous medium under appropriate conditions of shear, pH and temperature which are well known to those skilled in the art.

When used to polish or planarize the surface of a workpiece, the polishing agent is suspended in an aqueous slurry and may be prepared by appropriate methods as will be evident to the artisan. The concentration of solid polishing agent in the aqueous medium is generally about 5% to about 35% by weight, and more preferably, from about 8% to about 14%.

Generally, the aqueous slurries used in the present invention should be maintained at a pH of about 2 to about 12. In order to maintain the pH within the desired range, the aqueous slurry may further comprise an appropriate acidic or basic substance in an effective amount to maintain the desired pH. Examples of suitable acidic and basic substances which may be used include, without limitation, hydrochloric acid, nitric acid, phosphoric acid, sulfuric acid, potassium hydroxide, ammonium hydroxide or ethanolamine. Appropriate acids and bases as well as amounts thereof for a particular application will be evident to one skilled in the art based on the present disclosure. When using silica particles or cerium oxide as a polishing agent, the silica particles can be used without modification. Alternatively, alkaline agents, such as potassium hydroxide or ammonium hydroxide can be added. When using alumina particles as a polishing agent, acidic agents may be added to the slurry including, nitric acid, phosphoric acid, or the like.

In the present invention, filtration of the polishing slurry prior to treatment in a centrifuge is conducted using a filtration device comprising at least one filter having a pore size not greater than 25 microns. If the polishing slurry is being reclaimed for reuse, passage through the filter will remove contaminants of the polishing pads, polishing dross, and other foreign matter mixed in at the time of polishing by the CMP apparatus. Further, larger particles that may have coagulated in a newly prepared slurry are removed. Filtration membranes made from polycarbonate, triacetate cellulose, nylon, polyester, polypropylene, polyvinylchloride, cotton duck and twill, polyvinylene fluoride or the like may be used.

The flow of the polishing slurry through the system, whether previously used or not, is conducted by flowing the aqueous slurry from the slurry tank 14 through the filtering device 10 and into the centrifuge 12 at a pressure of about 0.01 to about 0.5 MPa. Preferably, the flow rate into the centrifuge is about 1 gpm to about 10 gpm, and more preferably from about 3.5 gpm to about 6 gpm. Flow of the aqueous slurry from the storage tank through the filter can be facilitated by a pump connected between the storage tank 14 and the centrifuge 12 on effluent line 16.

During filtration, large impurities having a particle diameter greater than the pore size of the filter, are retained by the filter and removed from the system. Further, as large particles aggregate on the filtering membrane and form a caking layer, impurities with diameters smaller than the filtration pore size may also be eliminated from the filtrate.

The aqueous slurry, after passing through the filtration device, is then introduced into a solid bowl, sedimentation-type centrifuge, such as disc-nozzle centrifuge 12 wherein the aqueous slurry is subjected to centrifugal forces for separation and removal of abrasive particles greater than 0.5 microns. Disc-nozzle centrifuges are constructed on the vertical axis 26 and are continuous in operation. The rotor bowl has a different shape. There is a vertical portion about midpoint 28 and the sections above 30 and below 32 this vertical portion are tapered to a conical section.

In the vertical section around the periphery of the rotor bowl, a plurality of openings or nozzles 18 are positioned. When the filtered aqueous polishing slurry enters into the bowl through internal channel 20, it flows into a feedwell 34 wherefrom the slurry enters into a separation chamber 36. Large centrifugal forces in the separation chamber cause a major portion of the larger particles to progress rapidly outward towards the nozzles. Thus, the larger particle solids are separated from the liquid in the disc stacks 24 due to the centrifugal force and the angle of the discs. The larger particle solids slide down into the double-conical solid bowl holding space and are continuously discharged through the nozzles.

By prior selection, the nozzles are selected to allow continuous discharge of the larger particle solids, therefore nozzle size is dependent on the size of the larger particles solids. The lighter solid material entrained in the liquid, is forced inwardly. Some particles will agglomerate and gain density to join the heavier materials to be passed out of the bowl at the nozzles. The remaining liquid and solids will flow up through the disc stack out of the centrifuge through aperture 38. Basically, the stack of separating discs effect a two fraction separation of the aqueous polishing slurry into a larger particle nozzle discharge slurry or so-called underflow fraction that slides outward to be discharged by the nozzles, and a light fraction or overflow liquid that continues inward and leaves through the aperture 38. The ratio of the overflow stream to the underflow stream should be maintained at about 1.0 to about 25, and preferably from about 4 to about 15.

The aqueous polishing slurry may be introduced into the bowl through the top opening of the bowl into the internal channel 20 which may surround the shaft 26. In the alternative, the feed supply can be injected from below to provide increased area for overflow at the top of the bowl.

The present invention is concerned with the mode of operation of the disc-nozzle centrifuge 12 and the relationship of operating parameters for separation of particles. Thus, the operating rotation speed of the centrifuge is generally from about 5,000 rpm to about 15,000 rpm. Preferably, the rotation speed is maintained in a range from about 6,000 rpm to about 10,000 rpm, and more preferably from about 8,000 rpm to about 8,500 rpm. The temperature of the aqueous slurry is preferably maintained at about 7° C. to about 66° C., and more preferably from about 43° C. to about 63° C. All internal jets within the centrifuge should be utilized and the size of the jets may range from about Number 40 to about Number 70, and most preferably are in the vicinity of Number 56. These jets should be carefully monitored to prevent plugging. The monitoring may be accomplished by watching an amp meter, which measures the electrical current into the electric motor of the centrifuge. Plugging is indicated by a gradual increase of current that reaches 110% of the nominal operating current.

Figure 2:
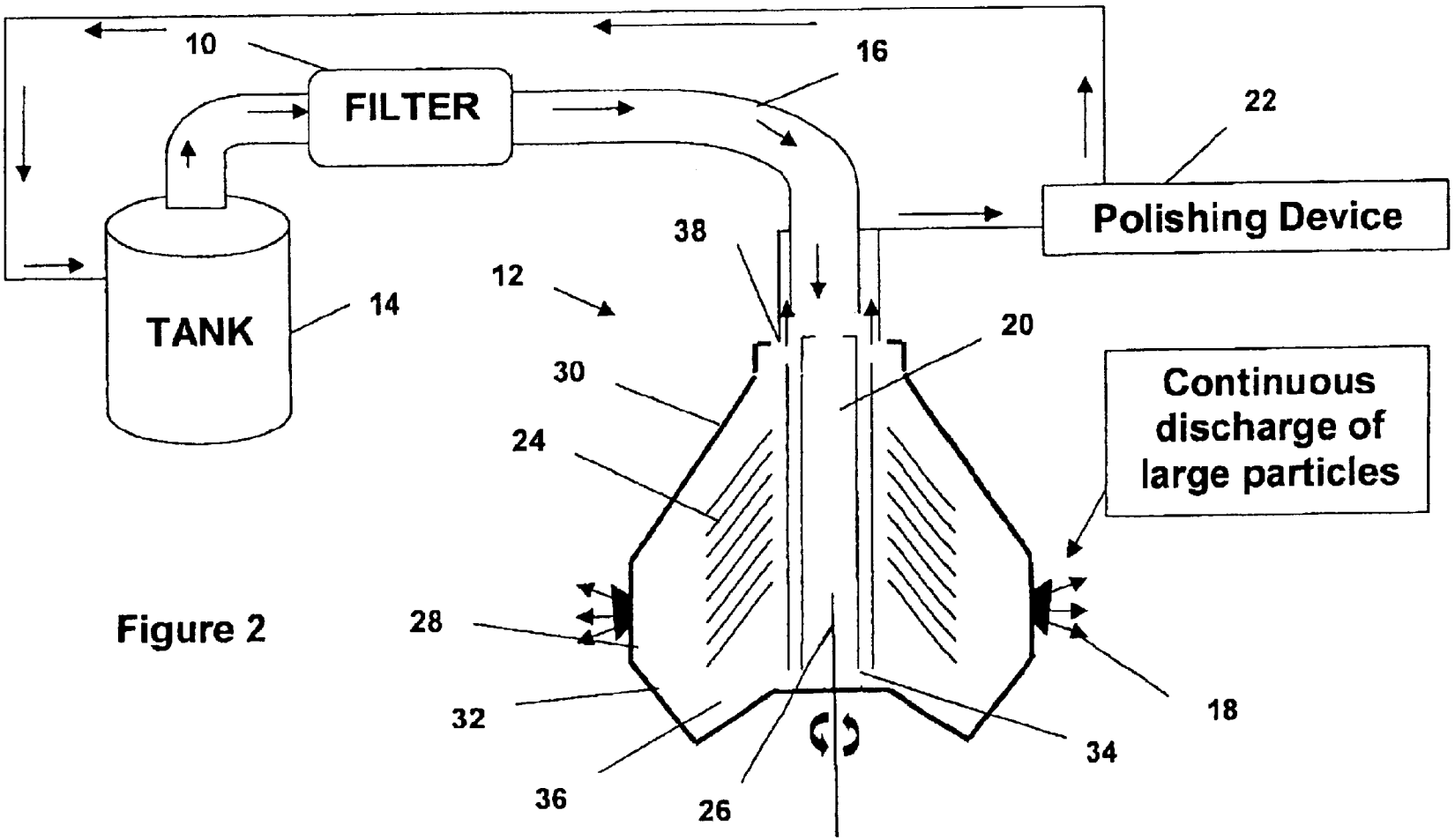
FIG. 2 is a diagrammatic view of the method and system of a second embodiment of the present invention for recovering water and slurry abrasives that have been used for chemical and mechanical polishing of semiconductor wafers.

FIG. 2 illustrates another preferred embodiment of the present invention wherein an aqueous polishing slurry utilized in the polishing device is removed therefrom and directed to the holding tank 14 for filtration and particle classification in the solid bowl, sedimentation-type centrifuge. The same process and system parameters discussed hereinabove are applicable to provide an efficacious aqueous polishing slurry for chemical and mechanical polishing of semiconductor wafers.

The present invention will now be illustrated by reference to the following specific, non-limiting example.

EXAMPLE 1

The characteristics of the polishing slurry treated according to the filtration-centrifuge process of the present invention were evaluated to determine defect density on a series of semiconductor wafers. The results were compared to the defect density caused by a polishing slurry that was not refined by the methods of the present invention.

A polishing agent solution, containing 30% of silica in an aqueous solution was prepared to be used for planarizing the surface of the semiconductor wafer having a silicon oxide film. The aqueous slurry was then filtered with a bag type-filter produced by US Filter having a pore size of about 25 microns. After filtration, the aqueous slurry, maintained at a temperature of about 25° C., was introduced into a Merco disc-nozzle type centrifuge. The centrifuge was configured with a slurry supply line, a water rinse line, a slurry underflow (reject) line and an overflow (product) line. All twelve of the internal jets of the centrifuge were installed to ensure optimal performance. The feed slurry flow rate into the supply line of the centrifuge was about 5 gpm. The centrifuge was operated at a rotating speed of about 8,000 rpm. The refined aqueous slurry was removed at the overflow (product) line and was used as the polished slurry.

The silicon oxide wafer was placed in an Auriga polishing apparatus manufactured by Speedfam/IPEC. The slurry treated according to the method of the present invention was applied to an appropriate polishing pad. The pad was positioned for polishing the surface of the work piece rotating at 40 rpm, and at a polishing pressure of 5 psi kg/cm$^2$.

After completing the polishing process, the surface of each polished wafer was inspected for the presence of scratches, surface defects, etc. Particle data was gathered using a Tencor 6420 and by viewing with the unaided eye in bright light.

For comparative analysis, additional sample wafers were polished with a polishing slurry that was not treated according to the filtration-centrifuge process of the present invention. The density defect results of the post-filtration-centrifuge slurries and comparative slurries are set forth in Tables 1 and 2.

TABLE 1

| Sample | Defect Density |
|---|---|
| Control Sample-Uncentrifuged | |
| Wafer 1 | 1318 |
| Wafer 2 | 1571 |
| 90210MCC-Centrifuged | |
| Wafer 1 | 13 |
| Wafer 2 | 21 |

TABLE 2

| Sample | Defect Density |
|---|---|
| Control Sample-Uncentrifuged | |
| Wafer 1 | 110 |
| 120987 co5-Centrifuged | |
| Wafer 1 | 28 |

As is evident from the data set forth in Tables 1 and 2 above, the silicon wafers polished with the filtered-centrifuged slurries of the present invention demonstrate a significantly lower degree of defect density when compared to the wafers polished by slurries that were not treated according to the method of the present invention.

What is claimed is:

1. A method for separating and removing potentially damaging particles in a polishing slurry prior to a chemical mechanical polishing process, the method comprising:

filtering an abrasive polishing slurry through a filter having a pore size not greater than 25 microns;

introducing the filtered polishing slurry into a solid bowl, sedimentation-type centrifuge comprising a vertical stack of thin discs;

separating abrasive polishing particulates having a particle size greater than about 0.5 micron from the filtered polishing slurry and ejecting the particulates through a plurality of nozzles on solid bowl sedimentation-type centrifuge to yield a product slurry; and continuously removing the product slurry from the solid bowl sedimentation-type centrifuge, the product slurry having abrasive particles of about 0.5 microns and less, to provide a polishing slurry for chemical mechanical polishing.

2. The method according to claim 1 wherein the filtered polishing slurry is introduced into the solid bowl, sedimentation-type centrifuge at a flow rate from about 1 gpm to about 10 gpm.

3. The method according to claim 2 wherein the centrifuge is rotated at a speed from about 6,000 rpm to about 10,000 rpm.

4. The method according to claim 1 wherein the filtered polishing slurry is introduced into the solid bowl, sedimentation-type centrifuge at a flow rate from about 3.5 gpm to about 6 gpm.

5. The method according to claim 4 wherein the centrifuge is rotated at a speed from about 8,000 rpm to about 8,500 rpm.

6. The method according to claim 5 wherein the filtered polishing slurry has a temperature from about 43° C. to about 63° C.

7. The method according to claim 6 wherein the filtered polishing slurry has a solids content of about 8% to about 14%.

8. The method according to claim 1 wherein the filtered polishing slurry has a temperature from about 7° C. to about 66° C.

9. The method according to claim 1 wherein the filtered polishing slurry has a solids content from about 5% to about 35%.

10. The method according to claim 1 further comprising adding a pH regulating agent to the polishing slurry.

11. A method for separating and removing potentially damaging particles from a waste polishing slurry recovered from a chemical mechanical polishing process, the method comprising:

filtering the waste slurry comprising abrasive polishing agents and waste debris through a filter having a pore size not greater than 25 microns;

introducing the filtered waste slurry into a solid bowl, sedimentation-type centrifuge comprising a vertical stack of thin discs;

separating abrasive polishing particulates and waste debris having a particle size greater than about 0.5 micron and ejecting same through nozzles on the periphery of the solid bowl sedimentation-type centrifuge yielding a purified polishing slurry; and continuously removing the purified polishing slurry from the solid bowl sedimentation-type centrifuge, wherein the polishing slurry comprises particles having a diameter not exceeding about 0.5 microns to provide a polishing slurry for a chemical mechanical polishing process.

12. The method according to claim 11 wherein the filtered polishing slurry is introduced into the solid bowl, sedimentation-type centrifuge at a flow rate from about 1 gpm to about 10 gpm.

13. The method according to claim 11 wherein the centrifuge is rotating at a speed from about 6,000 rpm to about 10,000 rpm.

14. The method according to claim 13 wherein the filtered polishing slurry is introduced into the solid bowl, sedimentation-type centrifuge at a flow rate from about 3.5 gpm to about 6 gpm.

15. The method according to claim 13 wherein the filtered polishing slurry has a solid content from about 8% to about 14%.

16. The method according to claim 11 wherein the centrifuge is rotating at a speed from about 8,000 rpm to about 8,500 rpm.

* * * * *